US008415891B2

(12) United States Patent
Cho et al.

(10) Patent No.: US 8,415,891 B2
(45) Date of Patent: Apr. 9, 2013

(54) LAMP BALLAST CIRCUIT AND DRIVING METHOD THEREOF

(75) Inventors: Gye-Hyun Cho, Bucheon (KR); Young-Sik Lee, Seoul (KR)

(73) Assignee: Fairchild Korea Semiconductor, Ltd., Bucheon (KR)

( * ) Notice: Subject to any disclaimer, the term of this patent is extended or adjusted under 35 U.S.C. 154(b) by 410 days.

(21) Appl. No.: 12/217,091

(22) Filed: Jul. 1, 2008

(65) Prior Publication Data

US 2009/0009099 A1 Jan. 8, 2009

(30) Foreign Application Priority Data

Jul. 3, 2007 (KR) ..... 10-2007-0066499

(51) Int. Cl.
*H05B 37/02* (2006.01)
*H05B 41/36* (2006.01)

(52) U.S. Cl.
USPC ..... 315/224; 315/209 R; 315/225; 315/291; 315/307; 315/311

(58) Field of Classification Search ..... 315/224, 315/225, 246, 247, 291, 109 R, 297–311, 315/209 R
See application file for complete search history.

(56) References Cited

U.S. PATENT DOCUMENTS 4,426,564 A * 1/1984 Steigerwald et al. ..... 219/624
4,992,702 A * 2/1991 Shimizu et al. ..... 315/219
5,696,431 A 12/1997 Giannopoulos et al.
6,285,138 B1 * 9/2001 Kataoka et al. ..... 315/291
6,429,603 B1 * 8/2002 Tsugita et al. ..... 315/224
6,914,395 B2 * 7/2005 Yamauchi et al. ..... 315/308
7,227,763 B1 * 6/2007 Noh et al. ..... 363/56.02
7,830,097 B2 * 11/2010 Kunimatsu ..... 315/291
2002/0041165 A1 4/2002 Cammack
2002/0067139 A1 6/2002 Sabate
2004/0012346 A1 * 1/2004 Green et al. ..... 315/291
2006/0158131 A1 * 7/2006 Mitsuyasu et al. ..... 315/209 R

FOREIGN PATENT DOCUMENTS

KR 2006089811 A * 8/2006

* cited by examiner

*Primary Examiner* — Douglas W Owens
*Assistant Examiner* — Thai Pham
(74) *Attorney, Agent, or Firm* — Sidley Austin LLP

(57) ABSTRACT

The present invention relates to a lamp ballast circuit and a driving method. The lamp ballast circuit includes a voltage detector for detecting the level of a first voltage corresponding to an input voltage, a controller including an oscillator for changing the oscillation frequency according to the level of the first voltage, and an output unit for changing the frequency of the output voltage in correspondence to the oscillation frequency. Therefore, a lamp ballast circuit having less power consumption and that is operable by a lesser input current with less THD and a driving method thereof are realized.

13 Claims, 10 Drawing Sheets

LAMP BALLAST CIRCUIT AND DRIVING METHOD THEREOF

CROSS-REFERENCE TO RELATED APPLICATION

This application claims priority to and the benefit of Korean Patent Application No. 10-2007-0066499, filed in the Korean Intellectual Property Office on Jul. 3, 2007, the entire contents of which are incorporated herein by reference.

BACKGROUND

1. Field of the Invention

The present invention relates to a lamp ballast circuit and a driving method thereof.

2. Description of the Related Art

Lamp ballast circuits control the driving of fluorescent lamps. In general, a fluorescent lamp has low power consumption. Further, the space in which a lamp ballast circuit is often positioned can be small, and hence the lamp ballast circuits themselves are often manufactured with a small size. Because of the size limit, the lamp ballast circuit typically does not contain a power factor correction circuit. Accordingly, the typical lamp ballast circuit has a very low power factor, and the total harmonic distortion (THD) of the input current is typically very high. Hence, it is difficult for the general lamp ballast circuit to satisfy the relevant IEC61000-3-2 standard for the THD thresholds of the current for lighting devices disclosed in Section 2, Part 3 of EMC for electromagnetic waves.

Further, when the THD of the input current is high, the current flows to a neutral line provided in the transmission cable, additional power loss or fire may occur, and hence additional measures are required.

Another problem arises from the fact that the typical lamp ballast circuit is not driven in a stable manner when the input voltage is unstable. In particular, when the input voltage is less than a rated voltage, power consumption of switches included in the lamp ballast circuit increase and the lamp ballast circuit may be damaged.

The above information disclosed in this Background section is only for enhancement of understanding of the background of the invention and therefore it may contain information that does not form the prior art that is already known in this country to a person of ordinary skill in the art.

SUMMARY

Briefly and generally, embodiments of the present invention include a lamp ballast circuit having limited power consumption, while possessing a great power factor, and a driving method thereof.

In some embodiments, a lamp ballast circuit for driving a lamp by using a first voltage corresponding to an input voltage includes: a voltage detector for detecting a level of the first voltage; a controller including an oscillator for changing an oscillation frequency according to a level of the first voltage; and an output unit for changing a frequency of an output voltage corresponding to the oscillation frequency.

In some embodiments, a method for driving a lamp ballast circuit including a first switch and a second switch coupled in series, includes: generating a first voltage by changing an external input voltage; changing the switching frequency when the first voltage is a second voltage; alternately turning on/off the first switch and the second switch according to the switching frequency; and driving the lamp by using a signal that is output to a node of the first and second switches.

In some embodiments, a lamp ballast circuit can substantially attenuate the high THD of the input current by varying the operational frequency according to the input voltage without including a power factor correction circuit.

In some embodiments, a lamp ballast circuit can reduce undesired power consumption generated by the switches and allow a stable operation by stably performing the zero voltage switching (ZVS) operation when the input voltage is less than the rated voltage.

DETAILED DESCRIPTION

Figure 1:
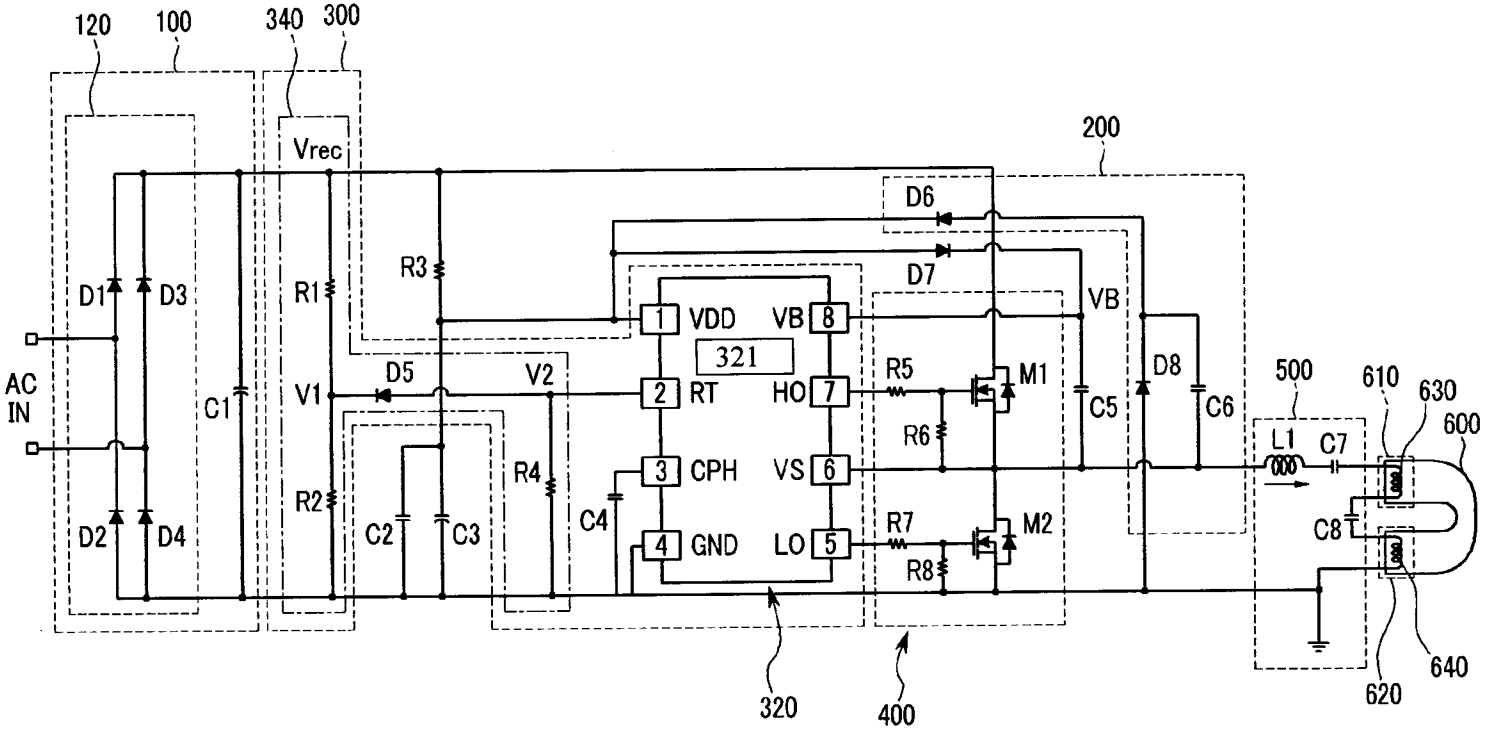
FIG. 1 shows a lamp ballast circuit.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. For clarification of drawings in the present invention, parts that are not related to the description will be omitted, and the same part will have the same reference numeral throughout the specification.

Throughout this specification and the claims that follow, when it is described that an element is "coupled" to another element, it means that the elements can be "directly connected" to each other, or they can be "electrically connected", with other element or elements between them.

FIG. 1 shows a lamp ballast circuit which can include an input voltage converter 100, a power supply 200, a controller 300, an output unit 400, and a lamp driver 500.

The input voltage converter 100 can include a rectification circuit 120 and a capacitor C1. The rectification circuit 120 can include diodes D1, D2, D3, and D4, and generate a DC voltage by rectifying an AC voltage that is input to the lamp ballast circuit through the diodes D1-D4). The capacitor C1 can generate a voltage Vrec by using the DC voltage that is output by the rectification circuit 120.

The power supply 200 can include diodes D6 and D8 and a capacitor C6. A first terminal of the capacitor C6 can be coupled to an output terminal of the output unit 400. An anode of the diode D8 can be grounded, and a cathode thereof can be coupled to a second terminal of the capacitor C6 and an anode of the diode D6. A cathode of the diode D6 can be coupled to pin 1 of a control IC 320.

The diodes D6 and D8 and the capacitor C6 may form a charge pump circuit, which generates a power supply voltage VDD by using a voltage Vs that can be output from the output unit 400 to the lamp driver 500, and supplies the power supply voltage VDD to the control IC 320.

The controller 300 can include the control integrated circuit IC 320, a voltage detector 340, and a capacitor C4. The control IC 320 may include eight pins 1 to 8. Here, the control IC 320 is not restricted to one type, and the number of pins of the control IC 320 can be different in different embodiments of the control IC 320. Also, the control IC 320 can be replaced with an equivalent circuit that performs the same function as the control IC.

The pin 1 of the control IC 320 can be coupled to the cathode of the diode D6 to receive the power supply voltage VDD from the power supply 200. Here, the power supply voltage VDD can be a power supply voltage for driving the control IC 320.

The pin 2 of the control IC 320 can be coupled to the voltage detector 340. The voltage detector 340 may detect the level of the voltage Vrec in order to change the operating frequency of an oscillator 321 in the control IC 320 according to the level of the voltage Vrec. The voltage detector 340 may include resistors R1, R2, and R4, and a diode D5.

A first terminal of the resistor R1 can be coupled to the first terminal of the capacitor C1, and a first terminal of the resistor R2 can be coupled between a second terminal of the resistor R1 and the ground. A cathode of the diode D5 can be coupled to a node of the resistor R1 and the resistor R2, and an anode thereof can be coupled to the pin 2 of the control IC 320. The resistor R4 can be coupled between the anode of the diode D5 and the ground.

The voltage detector 340 can be operated as follows. The oscillator 321 in the control IC 320 may output a predetermined current through the pin 2 to determine the oscillation frequency according to the voltage that is applied to the pin 2. The voltage detector 340 can vary the voltage applied to the pin 2 according to the level change of the voltage Vrec and change the oscillation frequency generated by the oscillator 321.

When the voltage Vrec is great and a voltage V1 at the node between the resistor R1 and the resistor R2 is greater than the voltage that can be generated by subtracting the threshold voltage of the diode D5 from a voltage V2 that can be applied to the resistor R4 that can be formed between the pin 2 of the IC 320 and the ground, the diode D5 can be turned off. Here, the current that can be output through the pin 2 of the control IC 320 may flow in the current path that can be formed to the ground through the resistor R4.

In the opposite case, when the voltage Vrec is small and the voltage V1 becomes less than the voltage that can be generated by subtracting the threshold voltage of the diode D5 from the voltage V2, the diode D5 can be turned on. As the diode D5 is turned on, the current that can be output through the pin 2 of the control IC 320 may flow to the ground through two current paths simultaneously. The current that is output through the pin 2 of the control IC 320 can flow through the current path that is formed from the pin 2 of the control IC 320 to the ground through the resistor R4, and the current path that is formed from the pin 2 of the control IC 320 to the ground through the diode D5 and the resistor R2. Therefore, the voltage applied to the pin 2 of the control IC 320 can be reduced.

The oscillation frequency, generated by the oscillator 321 in the control IC 320 can determine the switching frequency of the switches M1 and M2. As the oscillation frequency is changed by the voltage detector 340 according to the level of the voltage Vrec, the switching frequency of the switches M1 and M2 can be changed, and the power factor of the lamp ballast circuit can be improved, which will be described later.

In FIG. 1, the resistor R3 and the capacitors C2 and C3 may be used to supply the voltage to the pin 1 of the control IC 320 for driving the control IC 320 during a startup of the lamp ballast circuit. The resistor R3 and the capacitors C2 and C3 can be coupled as follows. A first terminal of the resistor R3 can be coupled to a first terminal of the resistor R1, and a second terminal of resistor R3 can be coupled to the pin 1 of the control IC 320. A first terminal of the capacitor C3 can be coupled to the second terminal of the resistor R3, and a second terminal thereof can be grounded. Also, the capacitor C2 can be coupled between the first terminal of the capacitor C3 and the ground.

The diode D7 and the capacitor C5 may be used to generate a voltage VB for driving the switch M1 of the output unit 400. The diode D7 and the capacitor C5 can be coupled as follows. An anode of the diode D7 can be coupled to a node of the pin 1 of the control IC 320 and a cathode of the diode D7 can be coupled to the pin 8 of the control IC 320. A first terminal of the capacitor C5 can be coupled to a node shared by the cathode of the diode D7 and the pin 8 of the control IC 320. A second terminal thereof can be coupled to an output terminal of the output unit 400. Here, the capacitor C5 can generate a voltage VB that can be greater than a voltage VS by a predetermined level by using the power supply voltage VDD. It can also transmit the voltage VB to the pin 8 of the control IC 320.

In general, in order to efficiently drive the lamp, the switches M1 and M2 can be driven with a high switching frequency during the startup of the lamp ballast circuit. The switching frequency can be reduced after a predetermined time. Embodiments of the lamp ballast circuit can drive the switches M1 and M2. The pin 3 of the control IC 320 can be grounded through the capacitor C4. The control IC 320 can change the switching frequency of the switches M1 and M2 according to the level of the voltage charged in the capacitor C4. For example, the switching frequency of the switches M1 and M2 can be maintained at a high value until the voltage charged in the capacitor C4 reaches a predetermined voltage by controlling a predetermined current to flow to the capacitor C4. The switching frequency of the switches M1 and M2 can be reduced when the capacitor C4 is charged to a predetermined voltage. The switching frequency of the switches M1 and M2 can be controlled by using the capacitor C4 as a timer. For example, when the capacitance of the capacitor C4 is big, the time for maintaining the switching frequency of the switches M1 and M2 at a high value can be also big.

The pin 4 of the control IC 320 can be grounded, and the pins 5 and 7 of the control IC 320 may be coupled to the output unit 400. The pin 8 of the control IC 320 can be coupled to the node shared by the diode D7 and the capacitor C5. The voltage VB at the first terminal of the capacitor C5 can be input to the pin 8.

The control IC 320 may output a signal HO for controlling the switch M1 through the pin 7, and outputs a signal LO for controlling the switch M2 through the pin 5. The signal HO can swing between the voltage VB and the voltage VS, and the signal LO can swing between the power supply voltage VDD and the ground voltage. The switching operations of the switch M1 and the switch M2 may be controlled according to the levels of the signal HO and the signal LO. When the signal HO becomes High, the switch M1 can be turned on, and when the signal LO becomes Low, the switch M2 can be turned on.

The output unit 400 may include resistors R5, R6, R7, and R8 and switches M1 and M2. A drain of the switch M1 can be coupled to the first terminal of the resistor R3, and a source thereof can be coupled to the node of the pin 6 of the control IC 320 and a drain of the switch M2. A drain of the switch M2 can be coupled to the node of the pin 6 of the control IC 320 and a source of the switch M1, and a source thereof can be grounded. A first terminal of the resistor R5 can be coupled to the pin 7 of the control IC 320, and a second terminal thereof can be coupled to a control electrode of the switch M1. A first terminal of the resistor R6 can be coupled to the second terminal of the resistor R5, and a second terminal thereof can be coupled to the node of the pin 6 of the control IC 320 and the switch M1 and the switch M2. A first terminal of the resistor R7 can be coupled to the pin 5 of the control IC 320, and a second terminal thereof can be coupled to the control electrode of the switch M2. A first terminal of the resistor R8 can be coupled to the second terminal of the resistor R7, and a second terminal thereof can be grounded. Here, the node of the switch M1 and the switch M2 can be coupled to the output terminal of the output unit 400.

The switches M1 and M2 may be N type MOSFETs in FIG. 1. Other embodiments may contain other types of switches, which are configured to perform analogous operations. Examples include P type MOSFETs.

The lamp driver 500 may include an inductor L1 and capacitors C7 and C8. A first terminal of the inductor L1 can be coupled to the output terminal of the output unit 400, and an output voltage Vs of the output unit 400 can be applied thereto. A first terminal of the capacitor C7 can be coupled to a second terminal of the inductor L1, and a second terminal thereof can be coupled to a first terminal of a filament 630 of a first terminal unit 610 of the lamp 600. A first terminal of the capacitor C8 can be coupled to a second terminal of the filament 630, and a second terminal thereof can be coupled to a first terminal of a filament 640 of a second terminal unit 620 of the lamp 600.

The lamp 600 may include the first and second terminal units 610 and 620. The respective terminal units 610 and 620 can include two ports and the filaments 630 and 640 for coupling the two ports 610 and 620.

Here, the inductor L1, the capacitors C7 and C8, and the lamp 600 may form a resonance tank. The resonance tank can be operable by the switching operation of the switches M1 and M2, which will be described later.

A frequency change of the output signal Vs of the output unit 400 corresponding to the level of the voltage Vrec will be described with reference to FIG. 2.

Figure 2:
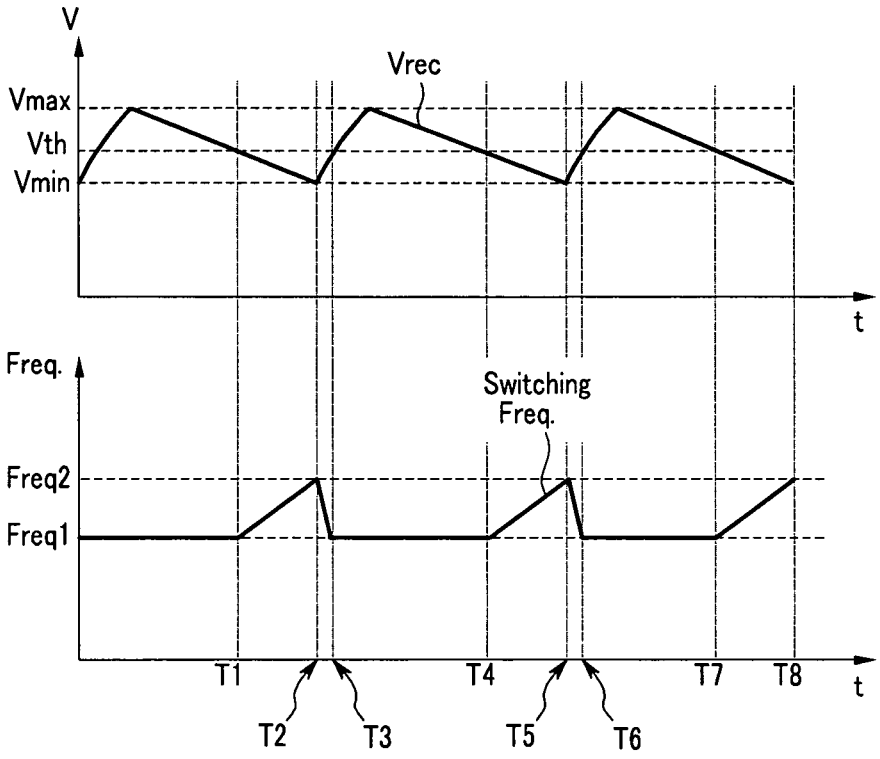
FIG. 2 shows a waveform of a voltage Vrec of a lamp ballast circuit and frequency variation of an output signal VS of an output unit.

FIG. 2 shows a waveform diagram of the voltage Vrec of a lamp ballast circuit, and frequency variation of the output signal VS of the output unit 400. The voltage Vth represents the level of the voltage Vrec, at which the voltage generated by subtracting the threshold voltage of the diode D5 from the voltage V2 is equivalent to the voltage V1 while the diode D5 is turned off. Also, the voltage Vth indicates the level of the voltage Vrec at which the input voltage of the lamp ballast circuit can be the rated voltage. Here, the rated voltage indicates the range of voltage in which the lamp ballast circuit can operate safely.

The voltage Vrec can swing between the voltage Vmin and the voltage Vmax in correspondence to the AC voltage that is input to the lamp ballast circuit.

At the time T1, the voltage Vrec can become smaller than the voltage Vth, and the diode D5 is turned on. Accordingly, the voltage V2 gradually falls from the time T1 to the time T2 when the voltage Vrec reaches the voltage Vmin. Thus, the oscillation frequency can be gradually changed and the frequency of the output signal VS of the output unit 400 can be gradually increased from the frequency "freq1" to the frequency "freq2".

At the time T2, the voltage V2 rises as the voltage Vrec rises from the voltage Vmin. Therefore, the oscillation frequency can gradually change, and the frequency of the output signal VS of the output unit 400 can gradually fall from the frequency freq2 to the frequency freq1.

At the time T3, the diode D5 can be turned off as the voltage Vrec becomes greater than the voltage Vth. Hence, the voltage V2, the oscillation frequency, and the frequency of the output signal VS of the output unit 400 recover the level they had before the time T1.

The process after the time T4 corresponds to the process from the time T1 to the time T3. Since the voltage Vrec can continuously swing between the voltage Vmin and the voltage Vmax, the frequency of the output signal VS of the output unit 400 can continuously change.

One of the reasons that the power factor of the lamp ballast circuit can be increased as the frequency of the output signal VS of the output unit 400 according to the change of the power supply voltage Vrec will now be described with reference to FIG. 3.

Figure 3A:
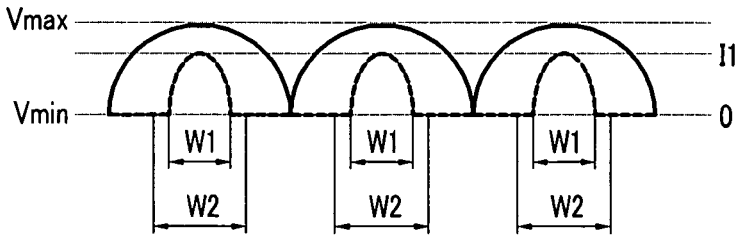
FIG. 3*a* shows a voltage Vrec corresponding to a frequency (freq1) of FIG. 2 and an input current.
Figure 3B:
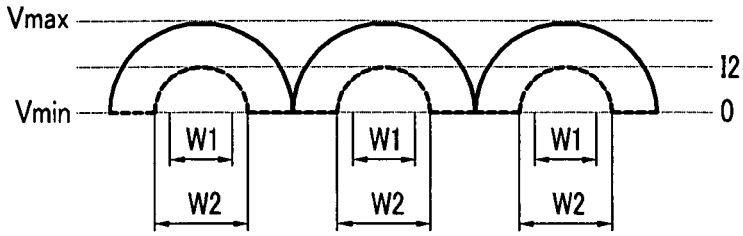
FIG. 3*b* shows a voltage Vrec corresponding to a frequency (freq2) of FIG. 2 and an input current.

FIGS. 3*a* and 3*b* illustrate the voltage Vrec with solid lines and the input current with dotted lines. FIG. 3*a* and FIG. 3*b* do not depict the real values of the voltage Vrec and the input current, but illustrate the voltage Vrec and the input current corresponding to the frequency of the output signal VS of the output unit 400. That is, FIG. 3*a* and FIG. 3*b* consider the part other than the lamp driver 500 in the lamp ballast circuit of FIG. 1 as a resistor, and show the voltage Vrec and the input current corresponding to the frequency change of the output signal VS of the output unit 400 shown in FIG. 2.

FIG. 3*a* shows a voltage Vrec and an input current corresponding to a frequency freq1 of FIG. 2. FIG. 3*b* shows a voltage Vrec and an input current corresponding to a frequency freq2 of FIG. 2. That is, FIG. 3*a* shows the case in which the diode D5 is turned off since the voltage Vrec is large enough, whereas FIG. 3*b* shows the case in which the diode D5 is turned on since the voltage Vrec is smaller.

The peak value I2 of the input current of FIG. 3*b* can be less than the peak value I1 of the input current of FIG. 3*a*. Also, the waveform of the input current can be very different from the waveform of the voltage Vrec, as shown in FIG. 3*a*, or it can be very similar, as shown in FIG. 3*b*. In detail, the input current shown in FIG. 3*a* increases with a steeper slope than the input current in FIG. 3*b*. Accordingly, the width W1 of the curve of the input current shown in FIG. 3*a* can be less than the width W2 of the curve of the input current shown in FIG. 3*b*. Also, the peak value I1 of the curve of the input current shown in FIG. 3*a* can be greater than the peak value I2 of the curve of the input current shown in FIG. 3*b*.

FIG. 3*a* shows the case in which the voltage Vrec is high and the diode D5 is turned off. In this case, the phase difference between the input current and the voltage Vrec that corresponds to the frequency freq1 of the output signal VS of the output unit 400, the THD of the input current, may be shown to be great.

On the other hand, FIG. 3*b* shows the case in which the voltage Vrec is low and the diode D5 is turned on. In this case, the phase difference between the voltage Vrec that corresponds to the frequency (freq2) of the output signal VS of the output unit 400 and the input current, and the THD of the input current, may be shown to be less.

The lamp ballast circuit can continuously change the switching frequency of the switches M1 and M2, and hence, the frequency of the output voltage VS of the output unit 400 can continuously changed, or "frequency-modulated", within the freq1-freq2 frequency range. Therefore, embodiments can generate the same effect as a continuous change of the THD of the input current and the phase difference between the voltage Vrec and the input current and inputting the input current and the voltage Vrec to the lamp ballast circuit. For this reason, the lamp ballast circuit can attenuate the high THD of the input current and the phase difference between the voltage Vrec and the input current without including the power factor correction circuit.

Typical lamp ballast circuits are not stably driven when the input voltage is unstably supplied. However, embodiments of the lamp ballast circuit are stably operated even when the input voltage becomes less than the rated drive voltage of the lamp ballast circuit. This is because the lamp ballast circuit of some embodiments uses the voltage detector 340 to change the switching frequency of the switches M1 and M2 according to the height of the voltage Vrec corresponding to the input voltage.

Unstable driving states arise, for example, when a voltage of less than the rated voltage is applied to the general lamp ballast circuit in which the oscillation frequency of the oscillator in the control IC 320 is maintained to be constant irrespective of the voltage Vrec. This is different from present embodiments of the lamp ballast circuit and will now be described with reference to FIG. 4 and FIGS. 5*a-d*.

Hereinafter, we describe a lamp ballast circuit where the resistor R4 is coupled only between the pin 2 of the control IC 320 and the ground, while all other parts of the lamp ballast circuit are formed similarly to the lamp ballast circuit of FIG. 1. In the above-configured general lamp ballast circuit, the oscillation frequency of the oscillator in the control IC 320 is maintained to be constant irrespective of the voltage Vrec. Also, when the output signal VS of the output unit 400 is changed into a signal with a resonance waveform according to resonance by the resonance tank configured by the inductor L1, the capacitors C7 and C8, and the lamp 600, the signal is referred to as an output voltage Vo.

Figure 4:
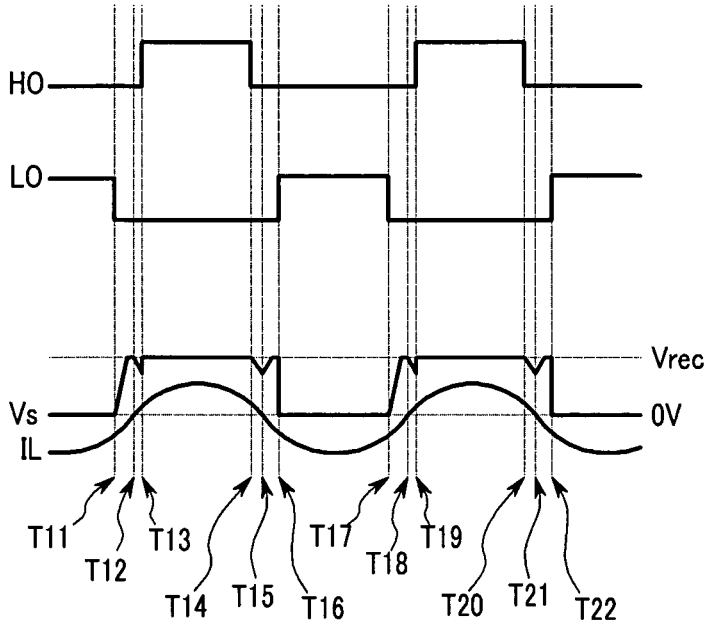
FIG. 4 shows a waveform diagram of a signal (HO), a signal (LO) of a general lamp ballast circuit, an output signal VS of an output unit 400, and a current (IL) flowing to an inductor L1 of a resonance tank when a voltage of less than the rated voltage is input.

FIG. 4 shows a waveform diagram of a signal HO, a signal LO of a typical lamp ballast circuit, an output signal VS of an output unit 400, and a current IL flowing to an inductor L1 of a resonance tank when a voltage of less than the rated voltage is input.

FIGS. 5*a-d* show current paths flowing to an output unit 400 and a lamp driver 500 in correspondence to the HO, LO signals shown in FIG. 4. As an illustration, FIG. 5*a* to FIG. 5*d* show the simplified output unit 400, the lamp driver 500, and the lamp 600 of the lamp ballast circuit so as to indicate the current path flowing to the output unit 400 in correspondence to driving of the switches M1 and M2. A resistor Rlamp indicates the equivalent resistance of the lamp 600.

Figure 5A:
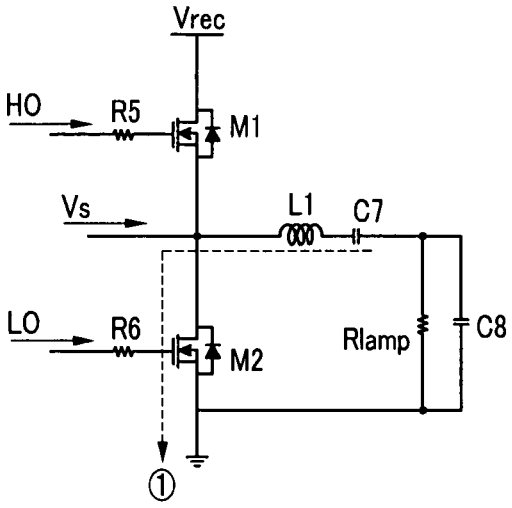
FIG. 5*a* to FIG. 5*d* show current paths flowing to an output unit 400 and a lamp driver 500 in correspondence to the signals (HO, LO) shown in FIG. 4.

Before time T11 the switch M2 is turned on and the signals LO and HO are high and low, respectively. Accordingly, as shown in FIG. 5*a*, the current flows through the first current path ① that is formed from the capacitor C8 and the resistor Rlamp to the ground through the capacitor C7, the inductor L1, and the switch M2. In this interval, the voltage VS can be the ground voltage ("0V" in FIG. 4), and the current flowing to the inductor L1 is reduced.

Figure 5B:
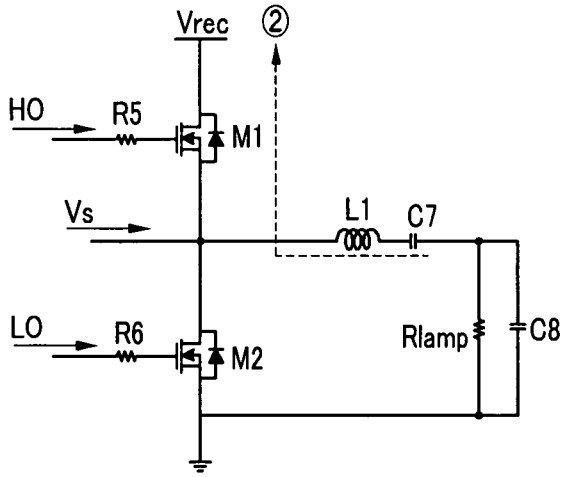

At the time T11, the signal LO can change to low and the switch M2 can be turned off. However, when the switch M2 is turned off, the direction of the current flowing to the inductor L1 does not change instantly. Hence, the current may freewheel to the voltage source Vrec for supplying the voltage Vrec through the body diode of the switch M1. As shown in FIG. 5*b*, at this time the current flows along the second current path ②, from the capacitor C8 and the resistor Rlamp to the voltage source Vrec through the capacitor C7, the inductor L1, and the body diode of the switch M1. The voltage VS raises to the voltage Vrec, and the current flowing to the inductor L1 can be reduced.

As the current flows through the second current path ②, the current flowing to the inductor L1 can be gradually reduced and the direction of the current flowing to the inductor L1 can change. In FIG. 4, the direction of the current flowing to the inductor L1 can change at the time T12.

Figure 5C:
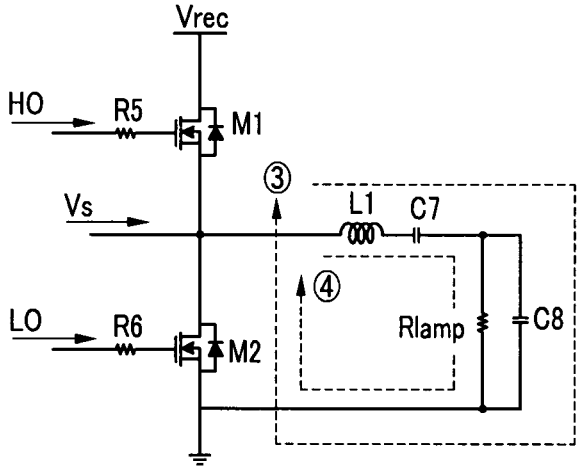

At the time T12, as shown in FIG. 5*c*, the current can flow simultaneously through the third current path ③ and the fourth current path ④. The third current path ③ includes a current flowing from the first terminal of the inductor L1 to the second terminal of the inductor L1, through the capacitor C7, the capacitor C8, and the body diode of the switch M2. The fourth current path ④ includes a current flowing from the first terminal of the inductor L1 to the second terminal of the inductor L1, through the resistor Rlamp and the body diode of the switch M2. As the current flows through the third and fourth current paths ③, ④, the voltage VS gradually falls from the voltage Vrec and the current flowing to the inductor L1 can be further reduced.

Figure 5D:
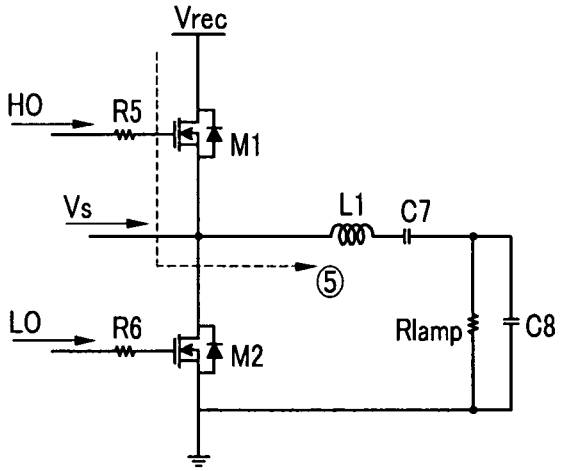

At the time T13, as the signal HO can be changed to high and the switch M1 can be turned on. When the switch M1 is turned on, as shown in FIG. 5*d*, the current flows along the fifth current path ⑤, flowing from the voltage source Vrec to the capacitor C8 and resistor Rlamp through the switch M1, the inductor L1, and the capacitor C7. At this time the voltage VS can steeply rise to the voltage Vref to thus generate a hard switching phenomenon. Accordingly, the current flowing to the inductor L1 can increase.

From the time T13 to the time T14, the switch M1 can remain turned on and the capacitor C7 can be charged. As the capacitor C7 is charged and the voltage difference between the voltage Vrec and the capacitor C7 is reduced, the current flowing to the inductor L1 can be reduced.

At the time T14, the signal HO can change to low and the switch M1 can be turned off. Since the direction of the current flowing to the inductor L1 is not changed when the switch M1 is turned off, the current flows through the third and fourth current paths ③, ④ shown in FIG. 5*c*. Accordingly, the voltage VS gradually falls from the voltage Vrec, and the current flowing to the inductor L1 can be reduced.

As the current flowing to the inductor L1 is continuously reduced, the direction of the current flowing to the inductor L1 can change. In FIG. 4, the direction of the current flowing to the inductor L1 can change at the time T15.

At the time T15, as shown in FIG. 5*b*, the current freewheels to the voltage source Vrec through the body diode of the switch M1. At this time the current flows through the second current path ② shown in FIG. 5*b*, the voltage VS rises to the voltage Vrec, and the current flowing to the inductor L1 can be reduced.

At the time T16, the signal LO can be changed to high and the switch M2 can be turned on. As the switch M2 is turned on, the current flows through the first current path ①, shown in FIG. 5*a*. Accordingly, the voltage VS can steeply fall to the ground voltage to thus generate a hard switching phenomenon, and the current flowing to the inductor L1 can increase because of the voltage difference between the voltage charged in the capacitor C7 and the ground voltage.

After the time T17, the process repeats the operation from the time T11 to the time T16.

When the input voltage is less than the rated voltage, the voltage VS can rise from the ground voltage to the voltage Vrec, and subsequently fall to the ground voltage to thus generate hard switching twice in one period in the above-described typical lamp ballast circuit. In detail, during the period from the time T11 to the time T16, hard switchings occur at the time T13 and the time T16. The hard switching by the switches M1 and M2 can substantially increase the power loss. The overload applied to the switches M1 and M2 can be shown as an increase of heat emission that occurs when the switches M1 and M2 may be driven to thus substantially increase the danger of damaging the switches M1 and M2 or damaging peripheral elements of the switches M1 and M2 and degrade the stability of the lamp ballast circuit.

In contrast to the description of typical lamp ballast circuits in FIGS. 4 and 5*a-d*, the switching frequency of the switches M1 and M2, included in the present embodiments of the lamp ballast circuit, can be increased when the voltage Vrec is reduced. Accordingly, the signals HO, LO shown in FIG. 6 can have a shorter period that those of the typical lamp ballast circuit shown in FIG. 4. The period of the signals HO, LO of the embodiments of the lamp ballast circuit can have the same period as the signals HO, LO of the typical lamp ballast circuit shown in FIG. 4 when the voltage Vrec is greater than the voltage Vth. However, embodiments have a shorter period when the voltage Vrec is less than the voltage Vth. The period change of the signals HO, LO prevents the hard switching that occurs in the switches M1 and M2 of the typical lamp ballast when the input voltage is low, which will be described with reference to FIG. 6.

Figure 6:
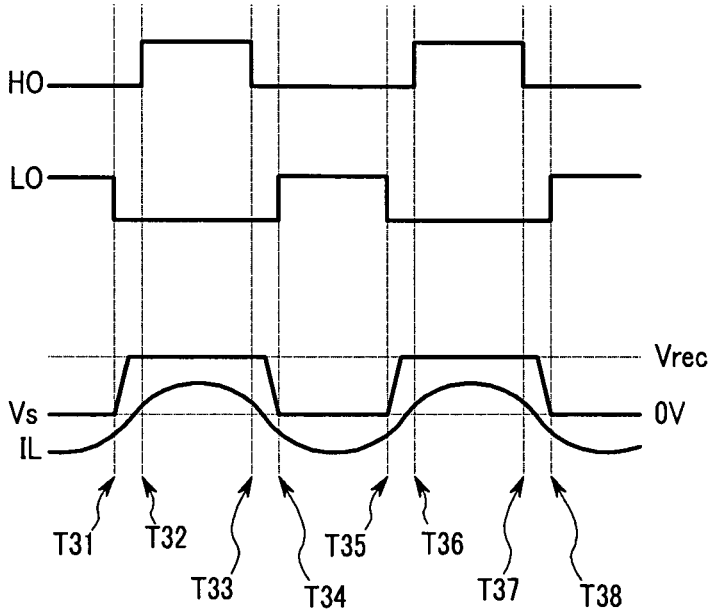
FIG. 6 shows a waveform diagram of a signal (HO), a signal (LO) of a lamp ballast circuit, an output signal VS of an output unit 400, and a current (IL) flowing to an inductor L1 of a resonance tank when a voltage of less than the rated voltage is input.

FIG. 6 shows a waveform diagram of a signal HO, a signal LO of a lamp ballast circuit, an output signal VS of an output unit 400, and a current IL flowing to an inductor L1 of a resonance tank when a voltage of less than the rated voltage is input.

Before the time T31, the signal LO and the signal HO can be high and low, respectively, and the switch M2 can be turned on. Accordingly, the current flows according to the first current path ① shown in FIG. 5*a*. The voltage VS can maintain the ground voltage (0V in FIG. 5) and the current flowing to the inductor L1 can be reduced.

At the time T31, the signal LO can be changed to low and the switch M2 can be turned off. However, when the switch M2 is turned off, the direction of the current flowing to the inductor L1 can be not instantly changed, and hence, the current freewheels to the voltage source Vrec through the body diode of the switch M1. That is, the current flows through the second current path ② shown in FIG. 5*b*. At this time, the voltage VS rises to the voltage Vrec and the current flowing to the inductor L1 can be reduced.

The current flowing to the inductor L1 can be gradually reduced as the current flows through the second current path ②. However, the time interval T31-T32 can be shorter than the interval T11-T13, shown in FIG. 4, and hence, the current flowing to the inductor L1 can not be reduced since the direction of the current flowing to the inductor L1 is changed before the time T32. Also, the voltage VS can be maintained at the voltage Vrec.

At the time T32, the signal HO can be changed to high, and the switch M1 can be turned on. When the switch M1 is turned on, the direction of the current flowing to the inductor L1 can not instantly change. Accordingly, the current flows through the third and fourth current paths ③, ④ shown in FIG. 5*c*. At this time, since the switch M1 is turned on, the voltage VS can be maintained at the voltage Vrec.

After the time T32, when the current flowing through the third and fourth current paths ③, ④ is reduced and the direction of the current flowing to the inductor L1 is changed, the current flows through the fifth current path ⑤ shown in FIG. 5*d*. At this time, the voltage VS can be maintained at the voltage Vrec, and the current flowing to the inductor L1 can be increased. As the current flows through the fifth current path ⑤, the capacitor C7 can be charged with a voltage, and hence, the voltage difference between the voltage Vrec and the capacitor C7 can be reduced and the current flowing to the inductor L1 can be reduced.

At the time T33, the signal HO can be changed to low and the switch M1 can be turned off. When the switch M1 is turned off, the direction of the current flowing to the inductor L1 can not be changed, and hence, the current flows through the third and fourth current paths ③, ④ shown in FIG. 5*c*. At this time, the voltage VS gradually falls from the voltage Vrec, and the current flowing to the inductor L1 can be reduced.

At the time T34, the signal LO can be changed to high and the switch M2 can be turned on. When the switch M2 is turned on, the direction of the current flowing to the inductor L1 can not be instantly changed, the current flowing to the inductor L1 can be reduced, and the current flows through the third and fourth current paths ③, ④ until the direction of the current flowing to the inductor L1 is changed. When the current flowing to the inductor L1 is reduced and the direction of the current flowing to the inductor L1 is changed, the current flows through the first current path ① shown in FIG. 5*a*. At this time, the voltage VS falls to the ground voltage, and the current flowing to the inductor L1 can be increased again.

The operation after the time T35 repeats the operation from the time T31 to the time T34.

Embodiments of the lamp ballast circuit can change the switching frequency of the switches M1 and M2 according to the level of the input voltage. Therefore, the zero voltage switching operation for reducing power consumption can be realized even if the input voltage is less than the rated voltage.

Embodiments of the lamp ballast circuit can continuously change the switching frequency of the switches M1 and M2 to attenuate the high THD of the input current and the phase difference between the voltage Vrec and the input current without including a power factor correction circuit. Further, embodiments of the lamp ballast can reduce power consumption and allow a stable operation by realizing the zero voltage switching when the input voltage is less than the rated voltage.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A lamp ballast circuit for driving a lamp by using a first voltage corresponding to an input voltage, the lamp ballast circuit comprising:

a voltage detector configured to detect a level of the first voltage;

a controller including an oscillator coupled to the voltage detector, wherein the voltage detector is configured (i) to change an oscillation frequency generated by the oscillator according to a difference between the level of the first voltage and a predetermined second voltage when the level of the first voltage is lower than the second voltage and (ii) to fix the oscillation frequency as a reference frequency when the level of the first voltage is greater than the second voltage; and an output unit configured to change a frequency of an output voltage corresponding to the oscillation frequency.

2. The lamp ballast circuit of claim 1, wherein the output unit is configured to change the frequency of the output voltage so as to be inversely proportional to a level of the first voltage.

3. The lamp ballast circuit of claim 1, wherein the lamp ballast circuit further includes a rectifier configured to generate the first voltage by rectifying the input voltage, and the voltage detector includes:

a first resistor and a second resistor, coupled in series between an output terminal of the rectifier and a voltage source and configured to provide a voltage indicative of the first voltage to the controller;

a diode having a cathode coupled to a node of the first and second resistors, and an anode coupled to the oscillator; and a third resistor coupled between the anode of the diode and ground.

4. The lamp ballast circuit of claim 3, wherein the rectifier is configured to full-wave-rectify the input voltage to generate the first voltage.

5. The lamp ballast circuit of claim 4, wherein the diode is operable to turn on when the first voltage is less than a fourth voltage that is greater than the second voltage and is less than a third voltage.

6. The lamp ballast circuit of claim 5, wherein the voltage detector is configured to fix the oscillation frequency generated by the oscillator as the reference frequency when the diode is not turned on, and to change the oscillation frequency generated by the oscillator in correspondence to the level of the first voltage when the diode is turned on.

7. The lamp ballast circuit of claim 6, wherein the voltage detector is configured to change the oscillation frequency to be inversely proportional to the level of the first voltage.

8. The lamp ballast circuit of claim 6, wherein the output unit comprises a first switch and a second switch coupled in series between an output terminal of the rectifier and the voltage source; and the controller is configured to alternately turn on/off the first and second switches, and to change the switching frequency of the first and second switches in correspondence to the oscillation frequency.

9. The lamp ballast circuit of claim 8, wherein the controller is configured to change the switching frequency of the first and second switches in proportion to the oscillation frequency.

10. A method for driving a lamp ballast circuit including a first switch and a second switch coupled in series, the method comprising:

generating a first voltage by modifying an external input voltage;

changing a switching frequency for the first and second switches by using an oscillator and a voltage detector coupled to the oscillator and configured to detect a level of the first voltage, wherein the voltage detector changes the switching frequency according to a difference between the level of the first voltage and a predetermined second voltage when the first voltage is lower than the second voltage;

maintaining the switching frequency for the first and second switches at a first frequency when the voltage detector detects that the first voltage is greater than the second voltage, alternately turning on/off the first switch and the second switch according to the switching frequency; and driving the lamp by using a signal that is output at a node of the first and second switches.

11. The method of claim 10, wherein the step of generating a first voltage includes generating the first voltage by rectifying the external input voltage.

12. The method of claim 11, further comprising alternately turning on/off the first switch and the second switch according to the switching frequency, wherein the step of turning on/off the first switch and the second switch includes:

outputting a voltage corresponding to the first voltage to the node when the first switch is turned on; and outputting a voltage corresponding to a third voltage to the node when the second switch is turned on.

13. The method of claim 11, wherein the step of changing the switching frequency includes changing the switching frequency of the first and second switches to a second frequency that is greater than the first frequency.

* * * * *